US005734305A

United States Patent [19]

Ervasti

[11] Patent Number: 5,734,305

[45] Date of Patent: Mar. 31, 1998

[54] STEPWISE SWITCHED FILTER

[75] Inventor: Kimmo Ervasti, Varjakka, Finland

[73] Assignee: LK-Products Oy, Kempele, Finland

[21] Appl. No.: 620,277

[22] Filed: Mar. 22, 1996

[30] Foreign Application Priority Data

Mar. 22, 1995 [FI] Finland ..... 951352

[51] Int. Cl.[6] ..... H01P 1/20

[52] U.S. Cl. ..... 333/204; 333/219; 333/235; 333/175

[58] Field of Search ..... 333/202–204, 333/206, 207, 219, 235, 174, 175

[56] References Cited

U.S. PATENT DOCUMENTS

| | | | |
|---|---|---|---|
| 4,353,038 | 10/1982 | Rose et al. | 331/36 |
| 4,660,002 | 4/1987 | Iijima et al. | 332/16 |
| 5,298,873 | 3/1994 | Ala-Kojola | 333/202 |
| 5,543,764 | 8/1996 | Turunen | 333/202 |

FOREIGN PATENT DOCUMENTS

| | | | |
|---|---|---|---|
| 0 520 641 A1 | 12/1992 | European Pat. Off. | H01P 1/205 |
| 2 548 846 | 7/1983 | France | H03H 9/24 |
| 2 612 017 | 3/1987 | France | H03B 5/12 |

*Primary Examiner*—Robert Pascal
*Assistant Examiner*—Darius Gambino
*Attorney, Agent, or Firm*—Darby & Darby

[57] ABSTRACT

The invention relates to a resonator structure and radio frequency filter in which the resonating frequency of a transmission line resonator can be switched in a stepwise manner between at least three values. The switching is implemented as follows: a regulating element including a switch that has at least three states is arranged in connection with the resonator. The three states of the switch correspond to different values of the specific impedance and, hence, the resonating frequency of the transmission line resonator. The regulating element is in accordance with a known arrangement: it may be e.g. a coupling element formed of a strip line on the surface of a low-loss substrate or ceramic, or a side circuit including a capacitive and inductive element, coupled to the resonator. In the former example the switch is open in its first state, in its second state it grounds one end of the coupling element directly and in its other states it grounds the end of the coupling element through differently dimensioned transmission lines. In the latter implementation the switch is open in its first state, in its second state it forms at the side circuit a capacitive-inductive coupling in series and in its third state it bypasses the inductive element.

15 Claims, 5 Drawing Sheets

STEPWISE SWITCHED FILTER

FIELD OF THE INVENTION

The present invention relates to a resonator structure and a radio frequency filter, which comprise a transmission line resonator, preferably a helix, strip line, dielectric or air-insulated resonator, and a regulating element by means of which the specific impedance of said resonator structure and, hence, the resonating frequency of the transmission line resonator can be changed in a stepwise manner.

BACKGROUND OF THE INVENTION

In radio transceivers it is generally used duplex filters based on transmission line resonators to prevent the transmitted signal from entering the receiver and the received signal from entering the transmitter. Each multichannel radio telephone network has a specified transmission and reception frequency band. Also the difference between the reception and transmission frequencies during connection, ie. the duplex interval, complies with the network specifications. The frequency difference between the pass band and rejected band of an ordinary bandpass or band rejection filter is also called a duplex interval. It is possible to design a filter suitable for each network. Current manufacturing methods enable flexible and economic production of different network-specific filters. The frequency adjustment methods, or the so-called switching methods, aim at dividing the networks into blocks, thereby making it possible to cover the whole frequency band by one smaller filter designed for one block only. The filter is always switched to the block in use, in other words, adjusted to the frequency range used.

Filter switching or frequency adjustment is based on changing the specific impedance and, hence, the resonating frequency of transmission line resonators included in the filter. The specific impedance is determined by the dimensions of the transmission line resonator and the grounded metal casing surrounding it as well as by regulation couplings arranged in the vicinity of the resonator. In prior art it is known a method for adjusting the resonating frequency of a transmission line resonator by placing a transmission line (FIG. 1) near the transmission line resonator, thereby producing an electromagnetic coupling M1 between it and the transmission line resonator, whereby the transmission line is called a coupling element. The electrical characteristics of the coupling element determine how the resonating frequency of the resonator is changed.

It is known to build a switched resonator, ie. one whose resonating frequency can be changed, by arranging, as shown in FIG. 1, a switch SW1 near a coupling element KE1, which, when it closes, grounds one end of the coupling element. Then the resonating frequency of the transmission line resonator SR is higher than with the switch SW1 open. With one coupling element and a two-state switch connected to it, it is possible to change the resonating frequency of the resonator only from one value to another. This kind of system is called two-step switching.

In some cases it is preferable that one frequency can be selected out of three or more alternatives for the resonating frequency. Then we are talking about switching in three or more steps. A conventional embodiment of multiple-step switching is presented in the Finnish Patent FI-88442 (U.S. Pat. No. 5,298,873) and it is illustrated in FIG. 2. In the method, two or more coupling elements KE1, KE2 and corresponding switches SW1, SW2 are placed in the vicinity of a transmission line resonator SR. The electromagnetic coupling between the coupling element 1 and the transmission line resonator is marked M1, and the coupling between the coupling element 2 and the transmission line resonator is marked M2. When all switches are open, the resonating frequency of the resonator has a certain value f1. When one switch is closed, the value of the resonating frequency becomes f2. By closing another switch the frequency is changed to a third value f3. The number of alternatives for the resonating frequency values is determined by the number of coupling elements and switches.

It is a disadvantage of the conventional arrangement that each coupling element and switch take room in the vicinity of the resonator, whereby resonators and filters consisting of them cannot be built very small. Size is of great importance, since the filters are used in small and lightweight mobile phones. In addition, the more coupling elements are used, the more the electromagnetic coupling between the resonator and the coupling elements affects the resonator's Q value. In the manufacturing process there also occurs certain deviation in the dimensioning of coupling elements, which results in variation in resonator characteristics, which is difficult to manage. The more coupling elements in one resonator, the greater the effect of the process deviation.

SUMMARY OF THE INVENTION

In the present invention the disadvantages mentioned above have been avoided. This is achieved by placing in the vicinity of the transmission line resonator one regulating element including a switch with at least three states. The switch changes the electrical characteristics of the regulating element. The three or more states of the switch correspond to the various electrical characteristics of the regulating element and, hence, the various specific impedance values of the resonator structure and so the various resonating frequencies.

It is characteristic of the invention that a regulating element is placed in the vicinity of the transmission line resonator, including a switch with at least three states which correspond to the various specific impedance values of the resonator structure.

The regulating element may be any of many alternatives included in prior art, such as a coupling element implemented as a strip line or a side circuit connected to the transmission line resonator. One preferable embodiment is a coupling element formed in the manufacturing process simultaneously with other strip line circuits included in the resonator and/or filter structure. It is characteristic of this embodiment that by changing the state of the switch connected to the coupling element the impedance of the coupling element is changed, which, in turn, changes the resonator's specific impedance and, hence, the resonating frequency. Since, according to the invention, there are at least three coupling element impedance values selectable by the switch, the system can be used to implement switching in three or more steps by using only one coupling element and one switch.

BRIEF DESCRIPTION OF THE DRAWINGS

The invention is described in greater detail with reference to the attached drawing, where.

DETAILED DESCRIPTION OF THE PREFERRED EMBODIMENTS

Figure 1:
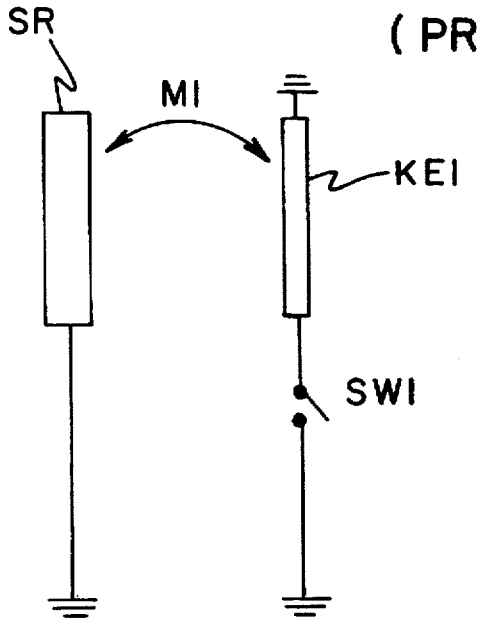
FIG. 1 (PRIOR ART)
FIG. 1 shows a known implementation of two-step switching.
Figure 2:
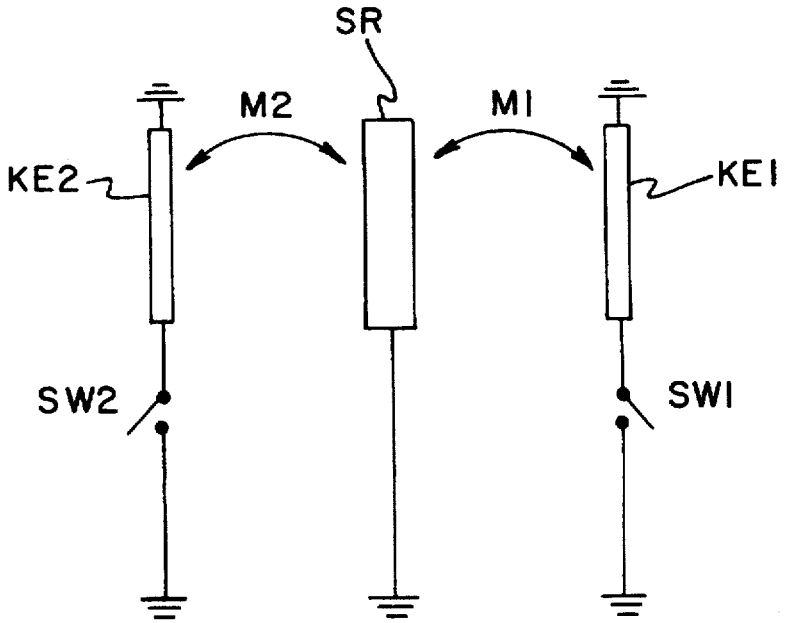
FIG. 2 (PRIOR ART)
FIG. 2 shows a known implementation of three-step switching.

Prior art couplings (FIGS. 1 and 2) were already described above, so the invention will be described below referring mainly to FIGS. 3 to 8.

Figure 3:
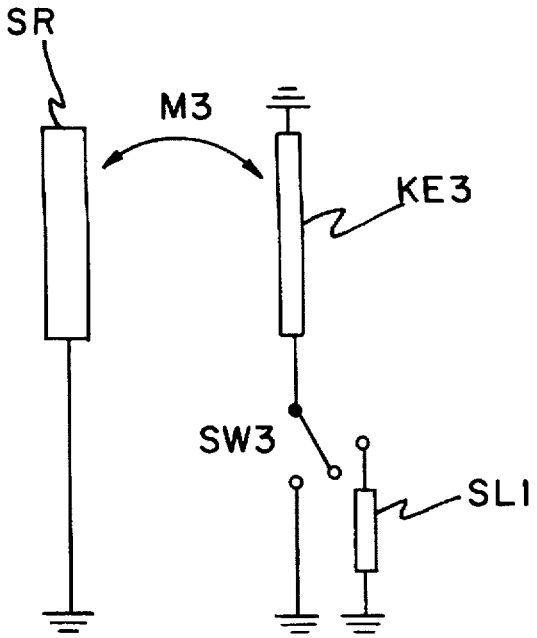
FIG. 3 shows the wiring diagram of an embodiment of three-step switching according to the present invention.

FIG. 3 shows a wiring diagram of an embodiment of the present invention. The wiring diagram includes a transmission line resonator SR and a coupling element KE3 placed near it, which through an electromagnetic coupling M3 has an effect on the resonating frequency of the resonator. A three-state switch SW3 is connected to the coupling element and it is either open, as shown, or grounds one end of the coupling element directly or grounds one end of the coupling element through a transmission line SL1.

In the first state the switch SW3 is open and the coupling element KE3 has an effect on the resonator's resonating frequency through the coupling M3. The resonating frequency has a value f1 which depends on the dimensioning of the transmission line resonator and the coupling element. In the second state the switch SW3 grounds one end of the coupling element directly, whereby the specific impedance of the resonator structure changes and the resonating frequency will have a value f2 which is higher than f1 according to the principle presented in the patent FI-88442 (U.S. Pat. No. 5,298,873). In the third state the switch SW3 grounds one end of the coupling element through a transmission line SL1, whereby the specific impedance of the resonator structure again changes and the resonating frequency will have a value f3 which is higher than f1 but lower than f2.

Figure 6:
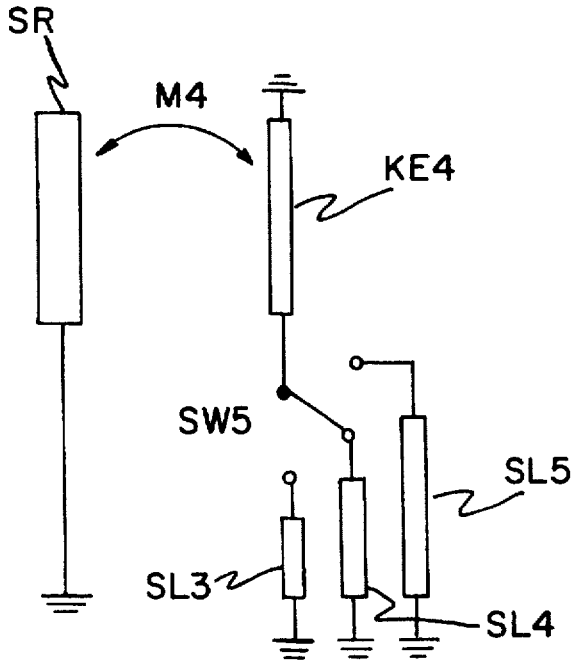
FIG. 6 shows the wiring diagram of a third embodiment of three-step switching according to the present invention.
Figure 7:
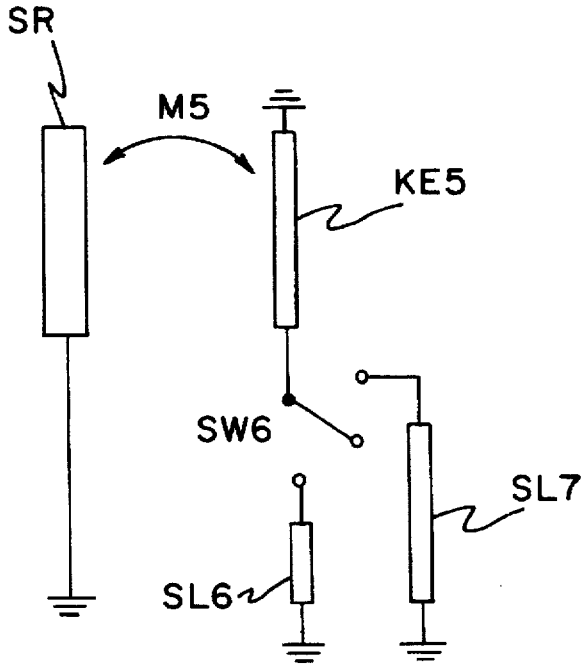
FIG. 7 shows the wiring diagram of a fourth embodiment of three-step switching according to the present invention.
Figure 8:
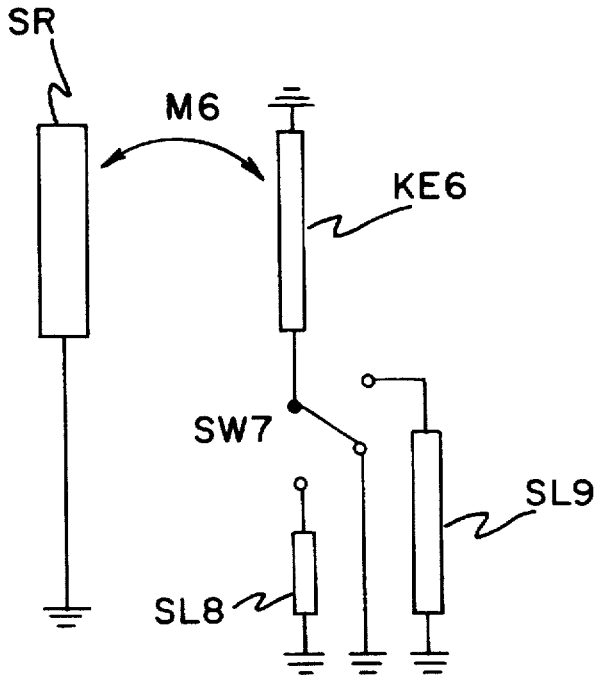
FIG. 8 shows the wiring diagram of a fifth embodiment of three-step switching according to the present invention.

According to the principle described it is also possible to implement switching in more steps. Then a switch will be used that has more than three states. Each state corresponds to a different impedance value e.g. so that the switch grounds one end of the coupling element through transmission lines dimensioned differently. FIG. 6 is the wiring diagram of an embodiment in which the states of a switch SW5 correspond to the groundings through differently dimensioned transmission lines SL3, SL4, SL5. The switch SW5 is not open in any of the states, and none of its states corresponds to the direct grounding of an end of the coupling element KE4. One of the states of the switch may be an open state (FIG. 7) and one of the states may be a direct grounding (FIG. 8), but neither of these is necessary from the point of view of the invention.

All components shown in the wiring diagrams—the transmission line resonator, the coupling element connected to it, the three-state switch and the transmission line— are known as such, and their technical implementation is not difficult to a person skilled in the art. The transmission line resonator is preferably a helix resonator formed of a conductor wound into a cylindrical coil or a hole plated with a conductive coating in a dielectric (e.g. ceramic) block. The coupling element and the transmission line are preferably strip lines formed on a low-loss substrate or on the surface of a ceramic. The three-state switch is preferably a PIN diode or a coupling comprising several PIN diodes. An embodiment implemented with strip lines is particularly preferable, because the strip lines can be manufactured simultaneously with other strip lines included in the filter structure and no other separate components apart from the switch diodes are needed in the coupling.

Figure 5:
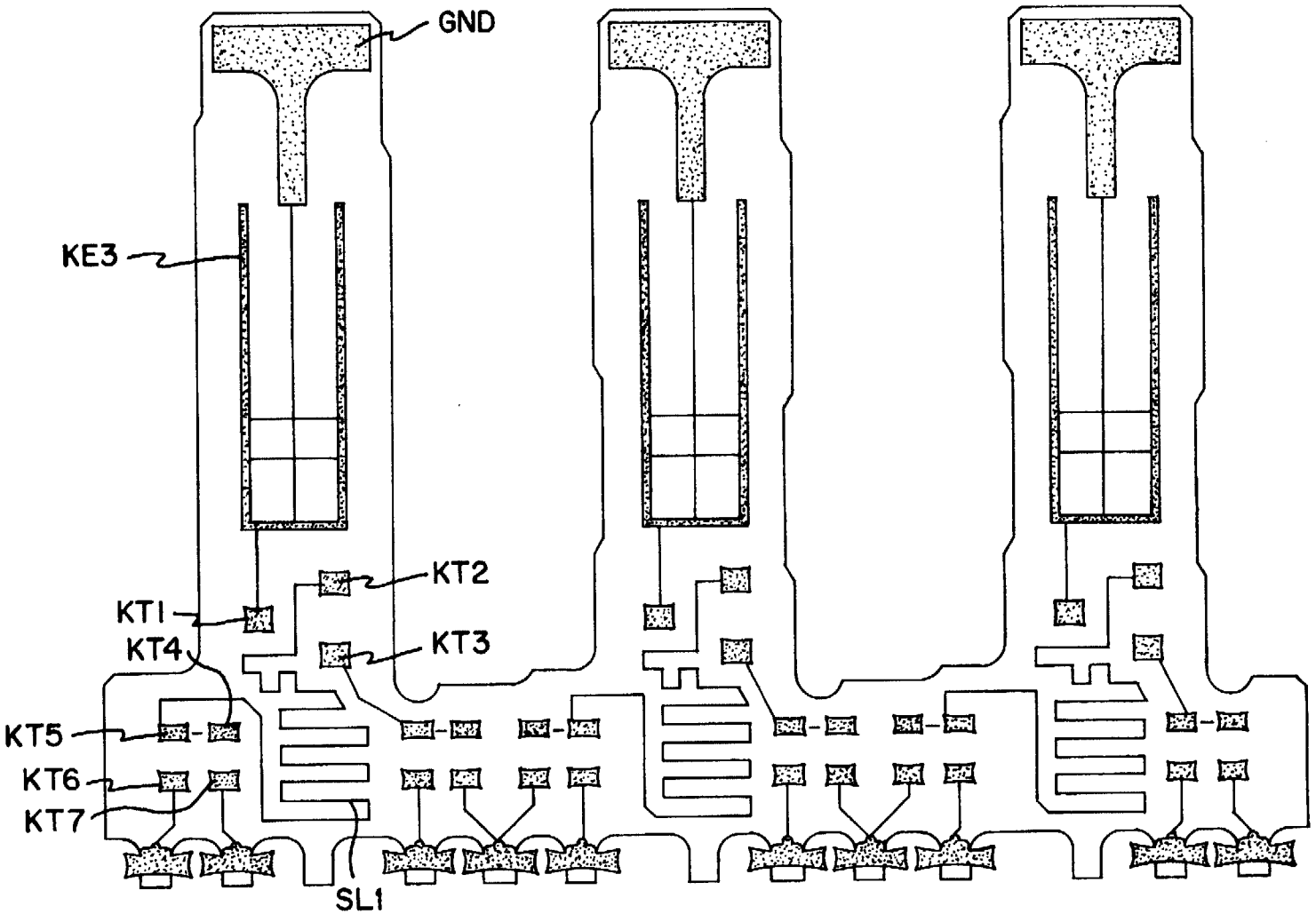
FIG. 5 shows a printed circuit board associated with the technical implementation of a helix filter according to the invention.

FIG. 5 shows a printed board used in the technical implementation of the first embodiment according to FIG. 3. It is a printed board for a comb-structured helix filter, in which each vertical branch is surrounded by a conductor wound into a cylindrical coil, ie. a helix (not shown). The printed board made of a low-loss substrate serves as a supporting element for the filter structure, and conductors and coupling pads required by electrical operation are formed on its surface with conventional methods. The conductor GND shaped like a broad T in the upper part of the branch makes a galvanic coupling to the ground potential for the coupling element KE3. A three-port component including two PIN diodes in a common-cathode coupling is attached to the coupling pads KT1, KT2, and KT3 below the coupling element. This component acts as a three-state switch SW3 in such a manner that the coupling functions are implemented with DC bias voltages connected to the ports. When the potential of the common cathode is higher than that of either anode the switch is open. When the potential of the common cathode is lower than that of one of the anodes the switch connects said anode to the common cathode.

A transmission line SL1 begins at a coupling pad marked KT2, having one end connected to the ground potential through a resistor attached to the coupling pads KT4 and KT7 and through a capacitor attached to the coupling pads KT5 and KT6. A corresponding grounding is arranged at the coupling pad KT3 without a transmission line.

Figure 4:
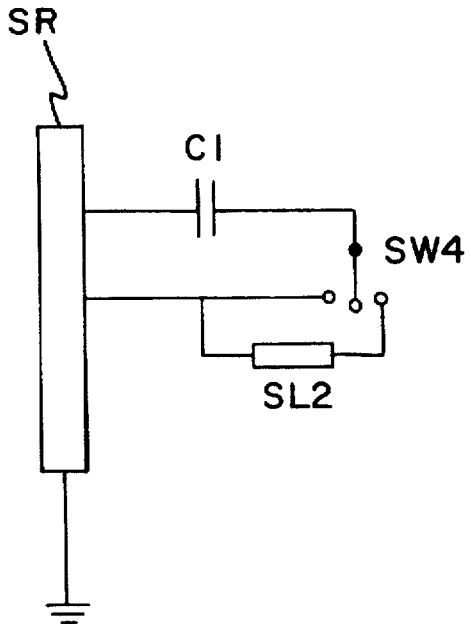
FIG. 4 shows the wiring diagram of a second embodiment of three-step switching according to the present invention.

FIG. 4 shows the wiring diagram of an alternative embodiment of the present invention. The wiring diagram includes a transmission line resonator SR and a side circuit which is galvanically coupled to it and includes a capacitive element C1, a transmission line SL2 and, according to the invention, a three-state switch SW4. In this embodiment only those transmission line resonators may be used where it is possible to have galvanic couplings at two locations for a side circuit. The transmission line resonator SR is preferably a helix resonator and the side circuit is formed of strip lines and separate components on a printed board which serves as a supporting structure for the helix resonator. Galvanic couplings are formed by soldering the strip line extending to the edge of the support branch to the resonator conductor.

Also in this embodiment the switch SW4 is preferably a common cathode coupling with two PIN diodes for which it is arranged bias voltagas, using strip lines on the surface of the printed board that serves as a supporting structure for the resonator. The switch is either open, as shown, or connects the capacitance C1 and the transmission line SL2 in series or bypasses the transmission line SL2 altogether. At lower radio telephone frequencies the capacitive element C1 is preferably a separate component, but at frequencies exceeding 1000 MHz it may also comprise strip lines on a printed board.

The invention has been described above only in connection with two frequency changing principles, but in no way is the invention limited to these two embodiments, but the multi-state stepwise switching of a coupling element or side circuit according to the invention can be employed in the implementation of many known frequency changing principles. What is essential from the point of view of all the embodiments is that the regulating element used for changing the resonating frequency is, as mentioned above, a switch having at least three states and providing versatile possibilities for the use of the regulating element, however simple.

The advantages of the invention compared to prior art methods are based on reduced need for space, among other things. The placement of one coupling element in the field of the transmission line resonator can easily be done also in the small filters required by hand phones. One coupling element also affects the resonator's Q value considerably less than the use of many coupling elements according to prior art. With the use of one coupling element only, the space available for the physical implementation of the coupling is, in the case of three-step switching, twice as big as in a conventional arrangement, and, in the case of switching in more steps, even bigger. Then the coupling can be made very stable and dimensioning deviation occurring in the manufacturing process will not result in great differences between individual filters.

Small filters according to the invention, capable of switching in three or more steps, have a wide range of application e.g. in hand-held phones of mobile telephone systems.

I claim:

1. A resonator structure including a transmission line resonator and a regulating element with which the specific impedance of said resonator structure and, thereby, the resonating frequency of the transmission line resonator can be changed in a stepwise manner, wherein, said regulating element comprises a switch which has at least three states that set at least two alternatively selectable current paths with different impedances, each said state corresponding to a value of the specific impedance of the resonator structure.

2. The resonator structure of claim 1, wherein said regulating element is a circuit comprising a coupling element arranged in the vicinity of the transmission line resonator.

3. The resonator structure of claim 2, wherein said coupling element comprises two connection points, said coupling element is grounded at the first connection point and said switch is connected to the second connection point.

4. The resonator structure of claim 3 further comprising a ground and a transmission line, wherein a) in its first state said switch is open, b) in its second state said switch is coupled to the ground, thus grounding the second connection point of the coupling element directly, and c) in its third state said switch is coupled to the ground through said transmission line, thus grounding the second connection point of said coupling element through said transmission line.

5. The resonator structure of claim 3 further comprising a ground and three transmission lines, wherein for each of said at least three states, said switch is coupled through a different transmission line to the ground, thus grounding the second connection point of the coupling element through different transmission lines.

6. The resonator structure of claim 3 further comprising a ground and two transmission lines, wherein a) in its first state said switch is open, b) in its second state said switch is coupled to the ground through said first transmission line, thus grounding the second connection point of the coupling element through said first transmission line, and c) in its third state said switch is coupled to the ground through said second transmission line, thus grounding the second connection point of the coupling element through said second transmission line.

7. The resonator structure of claim 3 further comprising a ground and two transmission lines, wherein a) in its first state said switch is coupled to the ground, thus grounding the second connection point of the coupling element directly, b) in its second state said switch is coupled to the ground through said first transmission line, thus grounding the second connection point of the coupling element through said first transmission line, and c) in its third state said switch is coupled to the ground through said second transmission line, thus grounding the second connection point of the coupling element through said second transmission line.

8. The resonator structure of any one of claims 2 to 7, wherein said coupling element and transmission lines are implemented with strip lines.

9. The resonator structure of claim 1, wherein said regulating element is a side circuit galvanically coupled to said transmission line resonator.

10. The resonator structure of claim 9 further comprising a capacitive element and an inductive element, wherein said elements are arranged so that a) when said switch is in its first state, said side circuit is open, b) when said switch is in its second state, said capacitive and inductive elements and the switch form a series connection coupled at its ends to the transmission line resonator, and c) when said switch is in its third state, said capacitive element and said switch form a series connection coupled galvanically at its ends to the transmission line resonator.

11. A radio frequency filter comprising at least two resonators of which at least one resonator includes a transmission line resonator and a regulating element with which the specific impedance of said resonator and, hence, the resonator's resonating frequency can be changed in a stepwise manner, characterized in that said regulating element comprises a switch which has at least three states that set at least two alternatively selectable current paths with different impedances, each said state corresponds to a different value of the specific impedance of the resonator structure.

12. A portable radio communication device including a resonator according to any one of claims 1–7, 9 and 10.

13. A portable radio communication device including a radio frequency filter as claimed in claim 11.

14. A portable radio as claimed in claim 12 characterized in that the coupling element and transmission lines are implemented with strip lines.

15. The resonator structure of claim 10, wherein said inductive element comprises a transmission line.

* * * * *